United States Patent [19]

Gunderson

[11] Patent Number: 4,881,852

[45] Date of Patent: Nov. 21, 1989

[54] METHOD AND APPARATUS FOR TENSIONING THE TETHERS OF A TENSION LEG PLATFORM

[75] Inventor: Richard H. Gunderson, Houston, Tex.

[73] Assignee: Exxon Production Research Company, Houston, Tex.

[21] Appl. No.: 146,989

[22] Filed: Jan. 22, 1988

[51] Int. Cl.[4] ..... E02B 17/00; B63B 35/44; B63B 21/50

[52] U.S. Cl. ..... 405/224; 405/203; 114/265

[58] Field of Search ..... 405/195, 203, 224; 175/7; 166/342, 343, 349; 114/264, 265

[56] References Cited

U.S. PATENT DOCUMENTS

| | | | |
|---|---|---|---|
| 4,281,613 | 8/1982 | Ray et al. | 114/230 |
| 4,352,599 | 10/1982 | Goldsmith | 405/224 |
| 4,379,657 | 4/1983 | Widiner et al. | 405/195 |
| 4,391,554 | 7/1983 | Jones | 405/224 |
| 4,432,670 | 2/1984 | Lawson | 405/224 |
| 4,468,157 | 8/1984 | Horton | 405/224 |
| 4,491,439 | 1/1985 | Watkins | 405/224 |
| 4,516,882 | 5/1985 | Brewer et al. | 405/224 |
| 4,540,314 | 9/1985 | Falkner | 405/224 X |
| 4,701,076 | 10/1987 | Chiu et al. | 405/224 |
| 4,733,991 | 3/1988 | Myers | 405/195 |
| 4,759,662 | 7/1988 | Peppel | 405/195 |

OTHER PUBLICATIONS

"New Tethering Method Key to TLP Design", no author named, Ocean Engineering, Mar. 1987, pp. 22–23.

"Tension Goes on at World's First Tension Leg Platform", Hutton, Offshore Engineer, Aug. 1984, pp. 26–29.

*Primary Examiner*—Dennis L. Taylor
*Assistant Examiner*—John A. Ricci
*Attorney, Agent, or Firm*—Richard F. Phillips

[57] ABSTRACT

Described herein are a system for securing and tensioning the tethers 12 of a tension leg platform 10 and a TLP installation method incorporating such a system. The tethers 12 preferably extend upward from the ocean bottom 16 to a position slightly below the bottom of the unballasted TLP hull 20. At least one tether tensioning tool 26 is situated within the hull 20 for lowering a tether extender 22 to each tether 12 and then biasing each tether-tether extender unit upward to tension the tether 12. The use of a removeable tensioning tool 26 avoids the need for a dedicated tensioning system for each tether 12. The tensioning system 28 of the present invention permits use of a simplified method for installing a TLP 10. Because the tethers 12 extend to an elevation which, at least initially, is below the draft of the TLP hull 20, the tethers 12 may be installed offshore prior to hull installation. Following tether installation, the hull 20 is floated to a position above the tethers 12 and the securing and tensioning system 28 is used to lock the hull 20 to the tethers 12.

36 Claims, 5 Drawing Sheets

30
52
22
36
24
34
12
84
26
64

METHOD AND APPARATUS FOR TENSIONING THE TETHERS OF A TENSION LEG PLATFORM

TECHNICAL FIELD

The present invention relates generally to tension leg platforms. More specifically, the present invention concerns tether installation and tensioning systems for tension leg platforms.

BACKGROUND OF THE INVENTION

In recent years, the search for offshore oil and gas reserves has been carried into water depths considerably deeper than those from which most offshore oil and gas production has been conducted to date. Producing oil and gas from these deep water regions presents a host of technical problems. One of the most challenging of these has been the development of deep water platforms from which drilling and production activities can be conducted. Most current drilling and production of offshore oil and gas is conducted from platforms consisting of a work deck supported above the ocean surface by a rigid concrete or tubular steel structure which is fixed to the ocean bottom. Such platforms are well suited for a water depths up to 250–350 meters. However, as water depths exceed this, it becomes increasingly difficult and expensive to produce a structure which will rigidly resist the wave, wind and current loadings imposed on it. It is generally considered economically impractical to drill and produce oil and gas reservoirs in water depths beyond about 400 meters using a rigid structure.

For deep water applications, a number of types of offshore structures have been proposed which avoid the strong depth sensitivities of conventional rigid offshore structures. One such alternate structure is the tension leg platform (TLP). The general configuration of a TLP is illustrated in FIG. 1 of the appended drawings. A TLP has a buoyant hull which supports a work deck from which drilling and producing activities are conducted. The hull is moored to a foundation on the ocean bottom by a set of elongate tethers which are secured to the buoyant hull under tension. The tensioned tethers maintain the hull at a significantly greater draft than it would assume if free floating. The balance of forces imposed by buoyancy and the tensioned tethers limits the degree to which the TLP undergoes motion in response to forces imposed by waves, ocean currents and wind. It has been suggested that TLP's could be employed in water depths up to 3000 meters, whereas the deepest present application of a conventional rigid offshore drilling and production structure is in a water depth of approximately 410 meters.

Though TLP's avoid many of the disadvantages faced by conventional rigid platforms in deep water, they do present their own special problems. One area of TLP design and operation that has proven especially troublesome concerns the system for installing and tensioning the tethers. In most TLP designs proposed to date the tethers are installed by lowering them to the ocean floor through the columns of the TLP hull itself. To permit this, the tethers are made up of threaded tubular segments which are secured together section by section as the tether is lowered. This arrangement presents a number of problems. The TLP hull must be provided with heavy hoisting equipment to support the great weight of the tether as it is lowered or raised. This decreases the payload capacity of the TLP. Additionally, the full length of the columns of the TLP hull must be reserved for the tethers. This space could otherwise be used for other purposes, such as housing drilling and production equipment. Further, through-column tether installation is very time consuming. This increases the vulnerability of the TLP to adverse weather during the installation process.

It would be desirable to develop a TLP which avoids the need for through column tether installation.

SUMMARY OF THE INVENTION

The apparatus and method detailed herein are useful for securing the tethers of a tension leg platform (TLP) to the TLP hull and subsequently tensioning the tethers. In a preferred embodiment, the TLP is provided with a set of tethers which extend upward from a foundation at the ocean floor to a position proximate the bottom of the TLP hull. The TLP hull is provided with a tether securing and tensioning system adapted to grasp the upper end of each tether. The tether securing and tensioning system includes a tensioning tool which is capable of being moved from tether to tether to tension each tether individually. This avoids the need for a dedicated tensioning system for each tether. The tensioning tool tensions each tether by pulling it upward relative to the hull and then locking it to the hull. The buoyant force of the hull maintains the tethers in tension. The tensioned tethers moor the hull above the foundation, restraining it against excessive pitch, heave, and roll motion under the influence of waves, wind, and ocean currents.

Also set forth is a method for TLP installation based on the use of preinstalled tethers. Prior to towing the TLP hull to the installation site, the tethers are preinstalled to an ocean bottom foundation. The tethers are sized to reach a depth slightly greater than the unballasted draft of the TLP hull. The tethers are provided with sufficient buoyancy to ensure that they remain substantially vertical prior to hull connection. Following tether installation, the TLP hull is towed to a position above the upper ends of the tethers. A first tether extender is lowered from within each column of the hull and is latched to a corresponding one of the tethers. The first tether extender bridges the gap between the upper end of the corresponding tether and the interior of the hull. After the tether extender is secured to the tether, a tether tensioning tool within each column is used to bias the tether upward relative to the hull to achieve the desired level of tether tension. The tether extender is then locked to the hull. The tensioning tool is then removed from the first tether extender, is moved to a second tether extender, and is used to tension the second tether. Thus, a single tether tensioning tool services all of the tethers corresponding to each column.

BRIEF DESCRIPTION OF THE DRAWINGS

For a better understanding of the present invention, reference may be had to the appended drawings, in which.

These drawings are not intended to serve to define the present invention, but are provided solely for the purpose of illustrating preferred embodiments and applications of the present invention.

DESCRIPTION OF THE PREFERRED EMBODIMENT

Introduction

The present invention concerns a tether tensioning tool useful in securing the hull of a tension leg platform (TLP) to a set of tethers extending upward from an ocean bottom foundation. This tensioning tool is moveable from one tether to another in the course of tether installation so that only a single tensioning tool is required to tension an entire set of tethers. This provides the TLP with significant space and weight savings and decreases the cost of the TLP. Further, because the tensioning tool can be readily moved upward from the tether tensioning station at the column bottom, maintenance of the tensioning system is greatly simplified. In another aspect, the present invention concerns a TLP installation method utilizing preinstalled tethers. However, the present invention is not limited to TLP's incorporating preinstalled tethers, but is also applicable to TLP's utilizing tether coinstallation and through-the-column installation.

Figure 1:
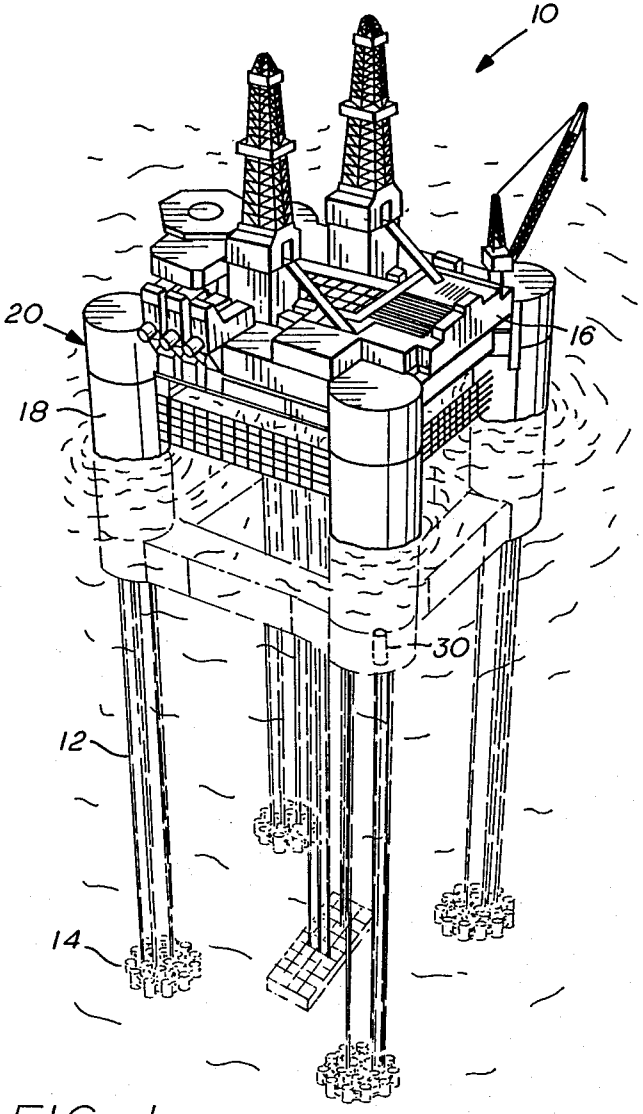
FIG. 1 shows a perspective view of a tension leg platform indicating the position of the tether securing and tensioning system of the present invention.

FIG. 1 shows a TLP 10 incorporating a preferred embodiment of the present invention. In this preferred embodiment, a plurality of tethers 12 extend upward from a foundation 14 at the ocean floor to a position immediately below the columns 18 of the buoyant TLP hull 20. The columns 18 support a work deck 16 a distance above the ocean surface. The tethers 12 are arranged in four sets, each set corresponding to a single column 18. Each tether 12 is secured to its corresponding column 18 by a tether extender 22, which bridges the gap between the interior of the column 18 and the upper end of the tether 12. Each tether extender 22 has a lower end provided with a latch 24 for releaseably securing the tether extender 22 to the upper end of the corresponding tether 12. The upper end of the tether extender 22 is supported within the column 18. A tether tensioning tool 26 is provided within each column 18 to bias each tether extender 22 within the column 18 upward relative to the TLP hull 20 after the tether extender 22 has been secured to the tether 12. This causes the hull 20 to assume a deeper draft than would be the case were it floating free. The resulting buoyant force of the hull 20 maintains the tethers 12 under tension. The tensioned tethers 12 greatly limit motion of the hull 20 in response to waves, ocean currents and wind.

The tether extenders 22 and tether tensioning tools 26 together form a tether securing and tensioning system 28. This tether securing and tensioning system 28 bridges the gap between the hull bottom and the tethers 12, permitting the use of tethers 12 which extend upward from the ocean floor to a position below the bottom of the hull 20. The existence of a vertical gap between the tethers 12 and the unballasted hull 20 greatly simplifies TLP installation. The tethers 12 can be secured to the ocean bottom foundation 14 prior to completion of the hull 20. Upon completion, the hull 20 is towed directly over the preinstalled tethers 12 and then secured thereto by the securing and tensioning system 28. This yields a much quicker and simpler installation than is possible with conventional through-the-column tether installation. Further, by avoiding the need to deploy the tethers 12 from the TLP hull 20, the TLP 10 does not require heavy tether hoisting equipment and the columns 18 do not have to accommodate the passage of tethers along their entire length. This reduces the total load which the TLP hull 20 must support and frees the interior of the columns 18 for oil and gas drilling and producing equipment.

The specific apparatus and method of the preferred embodiment of the present invention will now be described in detail.

The Tether Extender System

Figure 3:
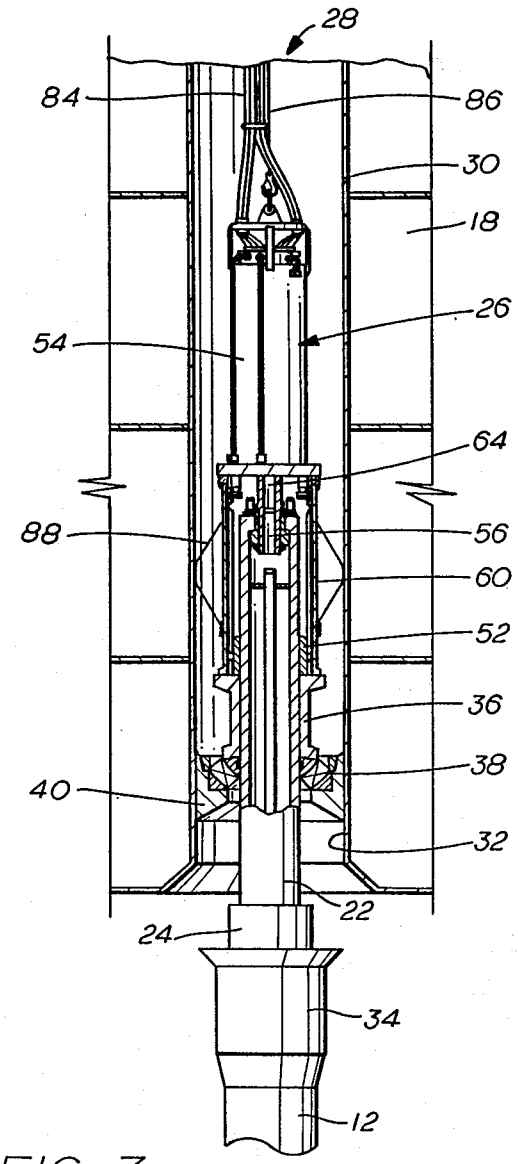
FIG. 3 is a partially sectioned, elevational view corresponding to FIG. 2.
Figure 2:
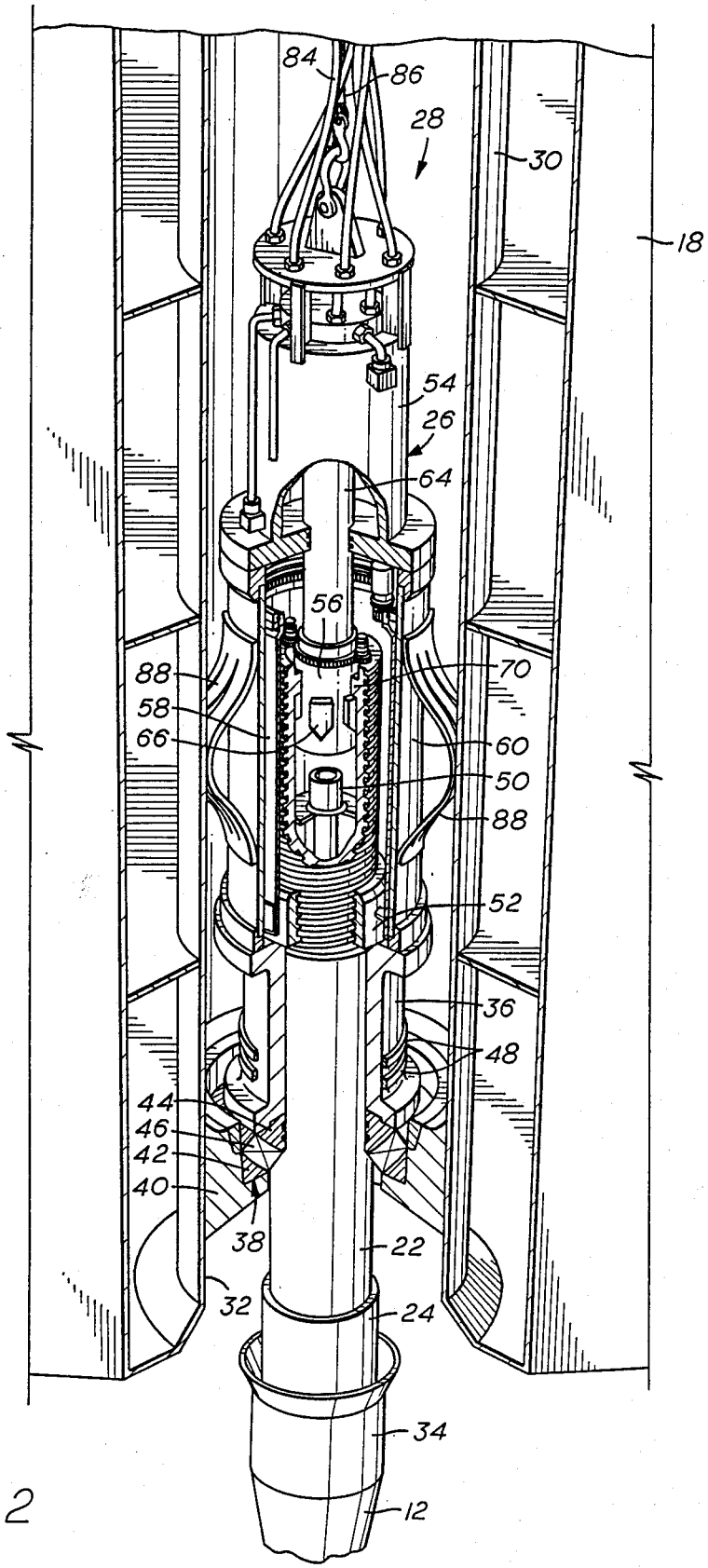
FIG. 2 shows a partially cut-away perspective view of the tether tensioning tool secured to the tether extender during the tether tensioning procedure.

As best shown in FIGS. 2 and 3, a number of tether extender shrouds 30 extend upward into each column 18 of the TLP hull 20. Each tether extender shroud 30 defines a recess 32 in the bottom of the hull 20 through which a tether extender 22 projects to interface with the corresponding tether 12. Each tether extender 22 has a latch element 24 at its lower end which is adapted to be secured to a corresponding latch element 34 at the upper end of the tether 12.

The tether extender 22 is supported within the shroud 30 by a load ring 36 and flex bearing 38. The flex bearing 38 rests on a flange 40 projecting into the shroud 30 near the base of the column 18. The flex bearing 38 has an annular lower member 42, an annular upper member 44 and a thickness of laminated elastomeric material 46 sandwiched between the upper and lower members 42, 44. The upper member 44 supports the load ring 36. The upper member 44 and load ring 36 define concentric bores through which the tether extender 22 passes. The purpose of the flex bearing 38 is to permit the tether extender 22 to pivot relative to the TLP hull 20. This is necessary to accommodate the normal hull motion occurring in the course of TLP operations. In a typical embodiment, the flex bearing 38 must permit the tether extender 22 to tilt a maximum of about 9° relative to the axis of the tether shroud 30 to accommodate the maximum design hull excursion anticipated in the course of heavy seas.

The bores of the flex element 38 and load ring 36 are slightly larger than the outside diameter of the tether extender 22. This permits the tether extender 22 to be moved upward and downward relative to the TLP hull 20. The upper end of the tether extender 22 is threaded. A tie-off nut 52 on this threaded section rests atop the load ring 36 to transfer downward loads from the tether extender 22 to the hull 20. The purpose of the load ring 36 is to space the threaded region of the tether extender 22 away from the annular seals in the flex bearing 38. The load ring 36 is provided with load monitors 58 to monitor tether tension. The load monitors 58 are preferably weldable strain gauges positioned on the outer surface of the load ring 36 and protected by steel collars.

Each tether extender 22 is provided with central access tube segment 50, best shown in FIG. 2. This central access tube segment 50 mates with the central access tube (not shown) of the corresponding tether 12. The central access tube system permits tether inspection tools to be run through the tethers 12. The upper end of the central access tube 53 is provided with a wireline removeable packer (not shown) at fabrication so that seawater ingress is prevented during installation. After connection and tensioning of the tether extenders 22, these packers are removed and a flexible upper central access tube segment is added between the tether extender 22 and a central access tube header tank on the mooring flat.

The Tether Tensioning Tool

A single tether tensioning tool 26 is located within each column 18 of the TLP 10 to tension the set of tethers 12 secured to that column 18. The tensioning tool 26 includes: a large hydraulic tensioning element 54 capable of developing the full tension load required for each tether 12; a latch 56 for locking the tensioning tool 26 to the upper end of the tether extender 22; an adjusting sleeve 58 for screwing the tie-off nut 52 up and down the tether extender 22; and a load sleeve 60 for transferring the tensioning loads from the tether 12 to the load ring 36. An overhead hoist (not shown) is provided for transferring the tensioning tool 26 from one tether extender 22 to another between tensioning operations.

The hydraulic tensioning element 54 is preferably a double acting hydraulic cylinder which is front-flange mounted atop the load sleeve 60. As best shown in FIG. 3, in operation of the tensioning tool 26, the lower end of the load sleeve 60 is supported on the upper flange of the load ring 36. The tensioning tool latch 56 secures the cylinder piston 64 directly to the upper end of the tether extender 22. Thus, in tensioning a tether 12, the hydraulic cylinder 54 applies loads directly between the tether extender 22 and the load ring 36. In the preferred embodiment, the hydraulic cylinder 54 has a stroke of about 1.50 m and is sized to develop a tether tensioning force of 9800 Kn (2200 kips).

Figure 4:
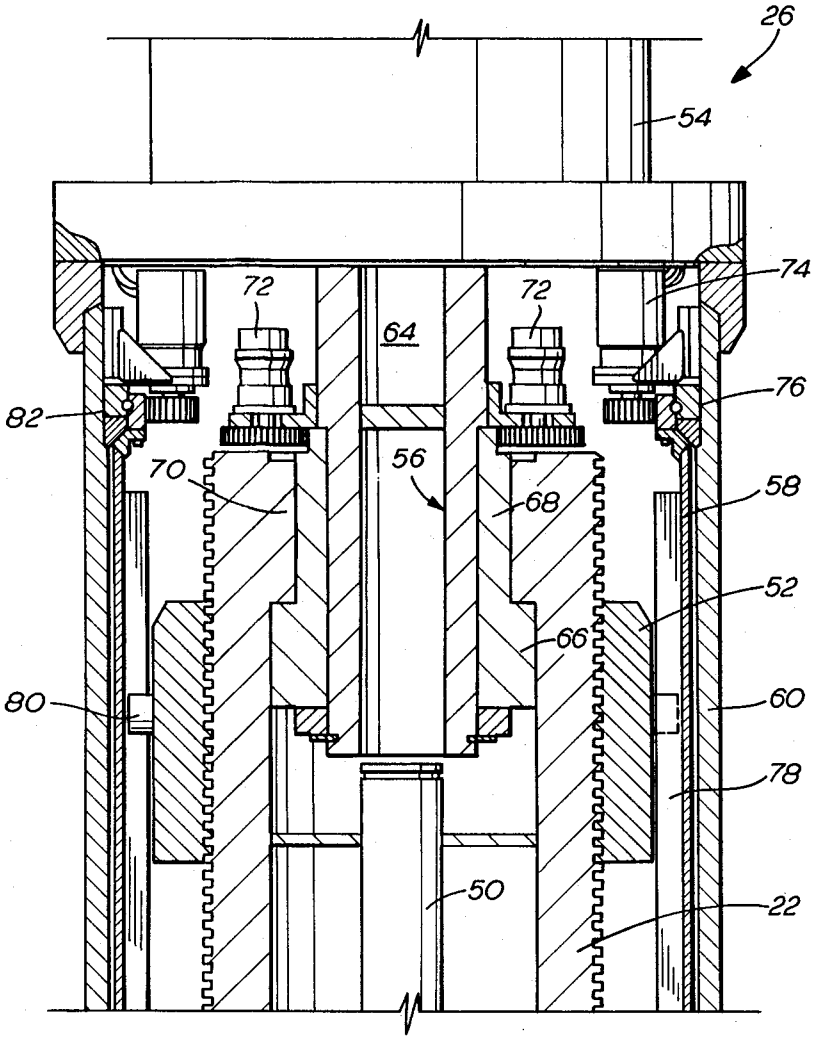
FIG. 4 is a detail in axial cross section of the upper end of the tether extender with the tether tensioning tool in position.

The tensioning tool latch 56 used to secure the tensioning tool 26 to the tether extender 22 is best shown in FIG. 4. The latch 56 is a shear lug connector having a set of inner shear lugs 66 secured to a sleeve 68 on the piston 64 and a set of outer shear lugs 70 secured to the inner diameter of the tether extender upper end. Fixed to the hydraulic cylinder piston 64 is a latch drive 72 consisting of two hydraulic motors adapted to rotate a toothed ring secured to the inner shear lug sleeve 68. The leading edges of the two sets of shear lugs 66, 70 are tapered. This causes the inner shear lug sleeve 68 to rotate until the inner shear lugs 66 are aligned with the gaps between the outer shear lugs 70 as the inner shear lug sleeve 68 is lowered into the tether extender 22. This permits the inner shear lugs 66 to pass downward through the outer shear lugs 70. Once the inner shear lugs 66 are fully below the outer shear lugs 70, the latch drive 72 is activated to rotate the two sets of shear lugs 66, 70 into vertical alignment. At this point, the hydraulic cylinder piston 64 is retracted slightly to cause the two sets of shear lugs 66, 70 to come into abutment, thus engaging the tensioning tool latch 56. Those skilled in the art will recognize that the tensioning tool latch 56 need not be a shear lug latch as described above. It could, for example, alternately be an internal collet latch, a dog latch, a cam latch, or a pinlock latch.

Once the tensioning tool 26 has moved the tether extender 22 upward a distance sufficient to develop the desired tension in the tether 12, the tie-off nut 52 is run down the threaded upper end of the tether extender 22 until it is seated atop the load sleeve 36. Adjustment of the tie-off nut 52 is accomplished by rotation of the adjustment sleeve 58. This rotation is performed by two hydraulic motors 74 mounted within the housing of the tensioning tool 26. A small pinion gear on the drive shaft of each motor 74 drives a mating gear 76 on the adjustment sleeve 58. The adjustment sleeve 58 has three longitudinal splines 78 running along its inner surface. As the adjustment sleeve 58 is rotated, these splines 78 drive against corresponding spigots 80 projecting outward from the outer surface of the tie-off nut 52 to rotate the tie-off nut 52. The adjustment sleeve 58 and drive gear 76 are mounted on a large diameter ball slew ring 82 to reduce frictional drag on the drive system.

The tensioning tool 26 is controlled via a series of hydraulic hoses 84 which pass downward through the tether extender shroud 30 from a control station located at the mooring flat above the shrouds 30. The tensioning tool 26 is raised and lowered on a steel hoist wire 86 and is kept centralized within the shroud 30 by radial centralizer springs 88. The axial position of the tether extender 22 is monitored by a digital displacement transducer mounted within the rear of the tensioning tool piston 26. The tensioning tool 26 is also provided with appropriate transducers to permit the position of the threaded ring 52 and the inner shear lugs 66 to be monitored in the course of the tensioning process.

The shroud 30 is adapted to be pressurized during normal operation to prevent water from entering the shroud 30. During the tether tensioning process the presence of the tensioning tool 26 within the shroud 30 precludes shroud pressurization. Accordingly, seals are provided at the interface between the flex bearing 38 and the support flange 40 and also between the flex bearing 38 and the tether extender 22 to minimize water intrusion during the tether tensioning.

The Tether Installation and Tensioning Procedure

The tether securing and tensioning system 28 detailed above permits the use of a TLP installation procedure utilizing preinstalled tethers. This results in a much quicker and less expensive TLP installation than is possible in a TLP employing conventional through-the-column tether installation. The initial step in installation of the present TLP 10 is to establish a tether foundation at the ocean floor. This may be accomplished using piled foundation templates as illustrated in FIG. 1. The tethers 12 are secured to the foundation 14 prior to the hull 20 being brought on site. The tether installation can in fact be performed while the hull is under construction, thus removing tether fabrication and installation from the critical scheduling path for construction.

There are two basic methods for accomplishing tether pre-installation. In one method each tether 12 is assembled from individual threaded tubular elements. The tether elements are transported to the installation site on a work barge. At the installation site, the tether elements are threaded together and lowered to the foundation 14 in a vertical orientation. The tethers have a net negative buoyancy but are provided with a buoyancy collar 90 (see FIG. 6) at their upper end to ensure that the tether 12 remains in a vertical orientation after being secured to the foundation 14 and released from the work barge. After the tethers 12 have been secured to the foundation template 14, they may be left unattended until later installation of the TLP hull 20.

In the alternate method of tether installation, each tether is assembled to its full length at a shore based construction site. The tethers 12 are then towed to the TLP installation site in a horizontal orientation. Supplemental buoyancy is added along the length of the tether 12 to ensure that it remains in the desired attitude while being towed. At the installation site the lower end of the tether 12 is rendered nonbuoyant by flooding, the removal of buoyancy modules or the addition of external weight. This upends the tether 12. The lower end of the tether 12 is then guided into the appropriate foundation latch.

Figures 5A, 5B, 5C, 5D, 5E, 5F:
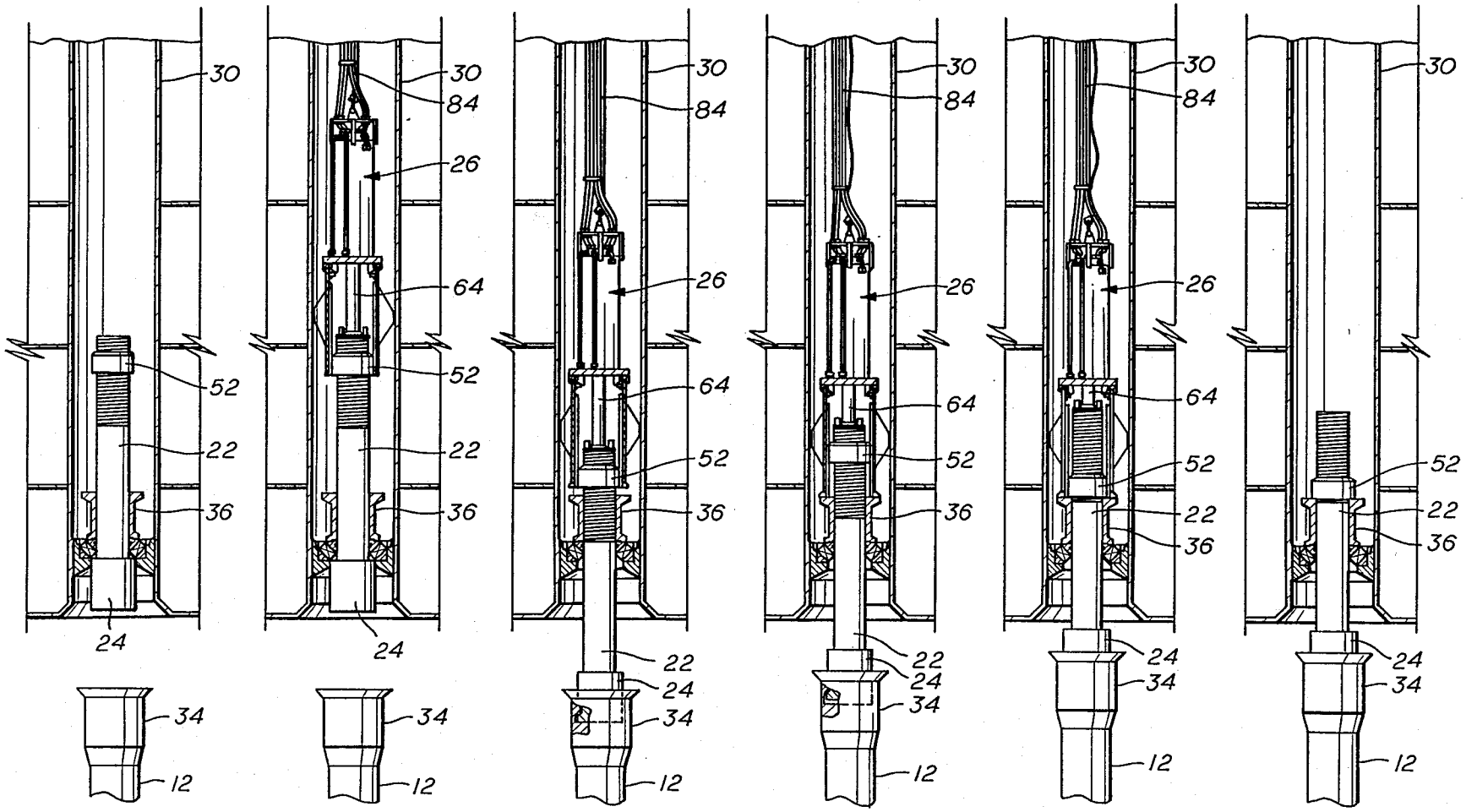
FIGS. 5A–5F are a sequence of views illustrating the principal stages in the tether tensioning procedure.
Figure 6A:
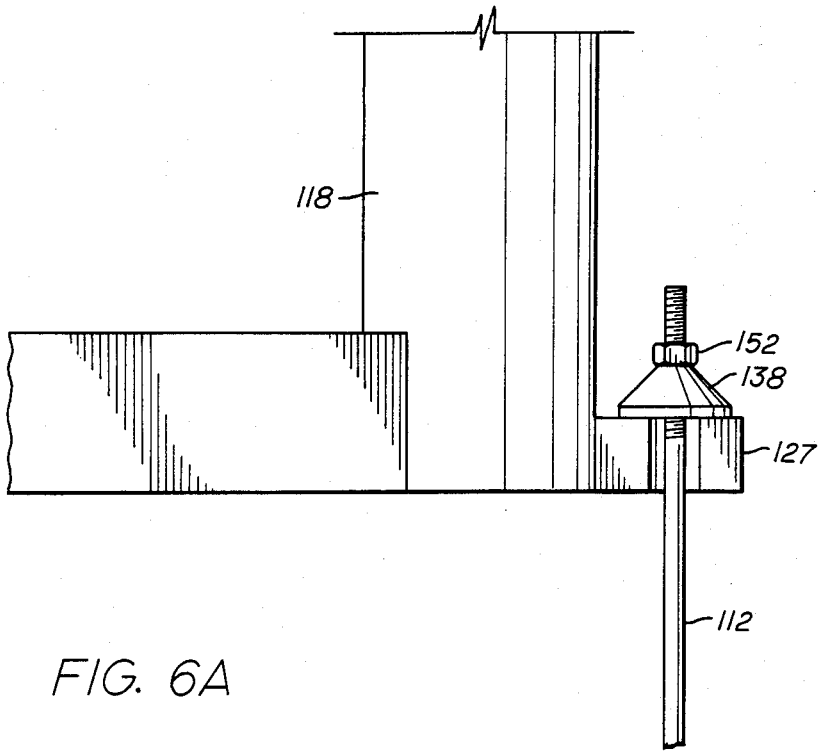

Once the tethers 12 are preinstalled and the hull 20 is complete, the hull 20 is towed to a position a short lateral distance from the installation location. The tether securing and tensioning process should be performed in calm seas, preferably with the significant sea level at one meter or less. This corresponds to a hull heave of about ±15 cm. With sea conditions this calm, the hull 20 is towed directly over the tethers 12. The tether extenders 22 must be retracted within the columns 18 during this operation, as shown in FIG. 5A, to ensure there is no interference between the extenders 22 and the tethers 12. In the preferred embodiment the tether extenders 22 are light enough that they are maintained in the retracted position by the hydrostatic pressure of the seawater acting at the column bottom. The initial step in making the tether-hull connection is to position the upper end of each tether 12 directly below its corresponding tether extender 22. To accomplish this, divers secure positioning cables 92 (see FIG. 6) from the upper end of each tether group 12 to the hull 20. The cables 92 are adjusted from the hull 20 until each tether group 12 is in vertical alignment with the corresponding tether extenders 22. An ROV inspection tool is used to monitor this operation.

The next stage in the installation process is to secure and tension one tether 12 to each of the four columns 18 of the hull 20. The various stages of this process are illustrated in FIGS. 5A–5F. The tensioning tool 26 within each column 18 is lowered onto the tether extender 22 corresponding to the tether 12 to be tensioned, as shown in FIG. 2B. During this operation, the tensioning cylinder 54 is fully extended so that the tensioning tool load sleeve 60 is maintained well above the load ring 36. The tensioning tool 26 is then latched to the tether extender 22 as described above. The weight of the tensioning tool 26 is sufficient to overcome the hydrostatic seawater pressure acting upward on the tether extender 22. Thus, by lowering the tensioning tool 26, the tether extender 22 is moved downward until it is seated a sufficient distance within the corresponding tether 22 so that the tether latch 34 can be activated to lock the tether extender 22 to the tether 12. This stage of the tether tensioning procedure is shown in FIG. 5C.

With the tether extenders 22 locked to the tethers 12 but not tensioned, heaving motion between the tethers 12 and the hull 20 resulting from wave action on the hull 20 causes vertical motion of the tether extender 22 within the flex bearing 38. This relative motion poses a potential problem in tensioning the first tether at each column 18. Were the hydraulic tensioning cylinders 54 of the tensioning tools 26 retracted at a constant rate to cause the tether tensioning tool load sleeve 60 to move downward to rest on the load ring 36 and then apply tension to the tether 12, the upward and downward motion of the hull 20 would cause the tensioning tool load sleeve 60 to repeatedly make and lose contact with the shroud load ring 36. This would impose snap loadings on the tether 12 and the tether securing and tensioning system 28. To prevent this, the tether tensioning and securing system 28 is provided with a motion compensating feature.

Once the tether extender 22 and tether 12 are latched, the tensioning cylinder 54 is allowed to passively reciprocate in response to hull motion. This is achieved by permitting local recirculation of hydraulic fluid between the annulus and full-bore sides of the cylinder piston 64. The hoist cable 86 is then given slack to cause the tensioning tool 26 to move downward until the load sleeve 60 rests atop the shroud load ring 36. After this is accomplished for the tensioning tool in each column 18, the tensioning tools 26 are simultaneously placed in heave suppression mode. In this mode a hydraulic circuit incorporating a one-way check valve is placed in line with each hydraulic cylinder 54 to permit it to freely retract but not to extend. This allows the hull 20 to fall with each wave trough but does not allow it to rise with the crest of the following wave. FIG. 5D shows the position of the tensioning tool 26 and tether 12 in the course of heave suppression. The tensioning tools 26 are maintained in this mode until a relatively great trough has passed and the hull can drop no further under then existing wave conditions. Though the preferred embodiment of the present invention employs a passive heave suppression system, those skilled in the art will recognize that as an alternative the hydraulic control system for the tether tensioning tool 26 could incorporate an active full motion compensation system.

Following the completion of heave suppression, the hydraulic cylinders 54 are switched to normal operating mode and then retracted until the desired tension is achieved in each tether 12. The tie-off nut adjustment sleeve 58 is then rotated as described above until the tie-off nut 52 is seated atop the load sleeve 36. This is shown in FIG. 5E. The hydraulic cylinder is then relaxed, the tension tool latch 56 is disengaged and the tension tool 26 is removed from the tether extender 22, as shown in FIG. 5F. The remainder of the tethers 12 in each column 18 are then tensioned. Heave suppression is not required for this since the first tensioned tether 12 at each column 18 prevents any significant vertical hull motion. After each tether 12 has been connected and tensioned it may be necessary to adjust the tension in each tether 12 to achieve a balanced system. Final tether tensioning is achieved by deballasting the hull 20.

Alternative Embodiments

Figure 6:
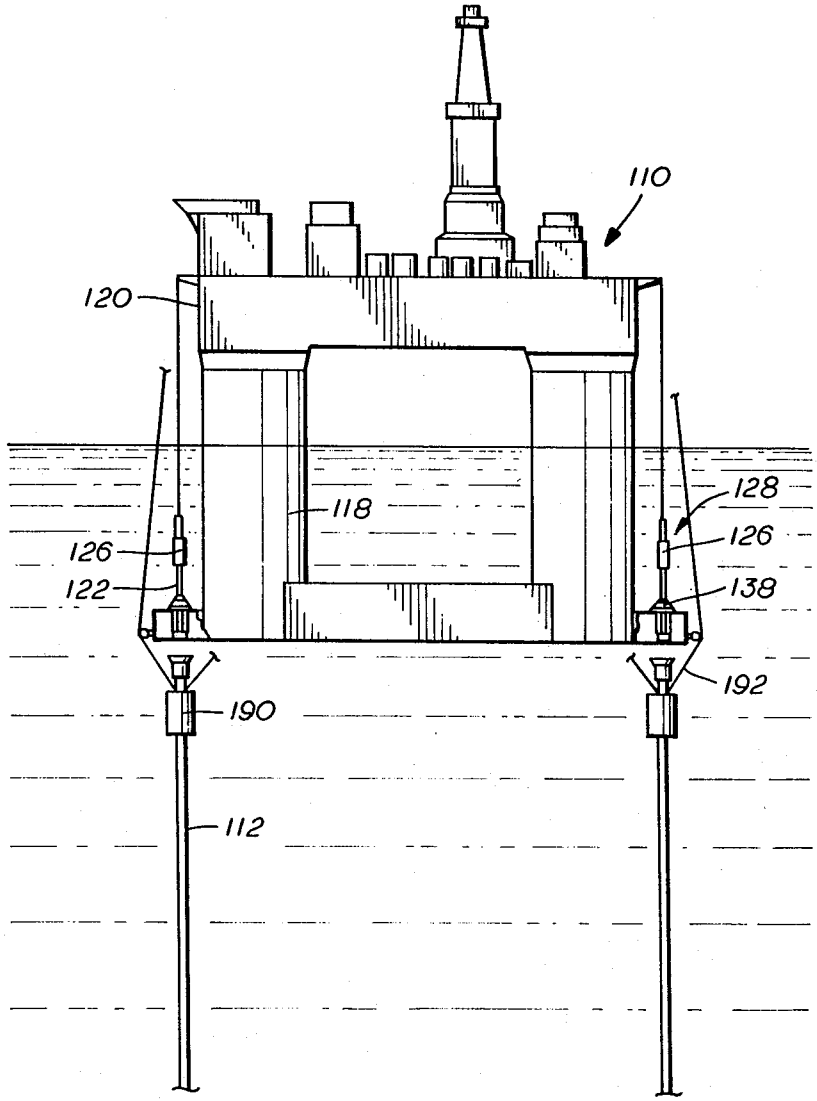
FIG. 6 is an elevational view of a TLP incorporating an embodiment of the present invention in which the tether extenders are secured to the hull at locations exterior to the columns.

FIG. 6 illustrates an embodiment of the present invention in which the tethers 112 are secured exterior rather than interior to each column 118. The advantage of this embodiment is that the full interior of each column 118 is freed to accommodate drilling equipment, etc. The tether securing and tensioning system 128 is substantially the same as in the preferred embodiment, with the only major difference being that there is no tether extender shroud and there is no need for sealing the interface between the tether extender 122 and the flex bearing 138 since the full system is exposed to seawater. The only significant distinction in the installation procedure is that there is no upward hydrostatic loading on the tether extender 122. After tether tensioning has been completed, some protection to the tether extender and other exposed components must be provided. This would possibly take the form of a lightweight, removable shroud element (not shown).

The tensioning tool 26 of the present invention can also be used in conjunction with through-the-column tether installation. Such an embodiment would require dedicated tether handling equipment on the TLP deck or within the columns. The tether would be screwed together and lowered section by section through the shroud elements. The last tether section consists of a reduced diameter threaded portion fitted with a flex element and tie-off nut. The tensioning tool is then attached to the top of this last section and the bottom of the tether is stabbed into the foundation. The tensioning tool is then used to tension the tether in the manner described above.

In a second alternative embodiment (not illustrated), the tethers are arranged exterior to each column and reach an elevation above the column bottom. The flex element, tie-off nut and other tie-off components form the upper portion of each preinstalled tether. Because of the increased tether height of this embodiment, the tether tops must be pulled horizontally outward by work boats into a clearance position to allow the hull to be towed into final position. With the hull in position, the tethers are guided into slotted tether connection brackets 127. Following this, the tensioning tool is used to tension the tethers in the manner described above for the preferred embodiment. The advantage of this side entry arrangement is an overall reduction in the number and complexity of the individual components. The tether extender becomes a part of the tether itself, avoiding the need for a stabbing-in operation.

The preferred embodiments of the TLP tether tensioning apparatus and corresponding TLP installation method have been set forth above. Those skilled in the art will appreciate that there are numerous alternative embodiments of the tensioning equipment and installation method all based on the general principles set forth above. Accordingly, it should be understood that the foregoing description is illustrative only, and that other apparatus and methods can be employed without departing from the full scope of the present invention as set forth in the appended claims.

I claim:

1. A tension leg platform, comprising:

a foundation element secured to an ocean bottom location;

a plurality of elongate, substantially vertical tethers, each of said tethers having a lower end secured to said foundation element and an upper end reaching a preselected distance below the ocean surface;

a buoyant hull positioned at the ocean surface above said tethers, said hull having a plurality of vertically extending columns, the upper end of each tether being secured to the lower portion of a corresponding column; and a tether tensioning and securing system having:

at least one tether tensioning tool and means for lowering said tensioning tool to a position proximate the lower portion of at least one column and for releaseably securing said tensioning tool to any tether within the group of said tethers corresponding to said column, whereby a plurality of said tethers can be individually tensioned by a single tensioning tool without the need for any form of tether connector extending to the top of the column.

2. The tension leg platform as set forth in claim 1, wherein said tethers being arranged in a plurality of sets, each set being secured to a corresponding one of said columns, each column housing a single tether tensioning tool.

3. The tension leg platform as set forth in claim 2, wherein said tether tensioning and securing system further includes a plurality of tether extenders, each tether extender corresponding to one of said tethers, said tether extenders each having a lower end adapted to be secured to the upper end of one of said tethers and an upper end adapted to be releaseably secured to said tether tensioning tool.

4. The tension leg platform as set forth in claim 2, wherein said hull has an unballasted draft which is less than the distance between the ocean surface and the upper ends of the tethers prior to tether tensioning.

5. The tension leg platform as set forth in claim 1, wherein said hull has an unballasted draft which is less than the distance between the ocean surface and the upper ends of the tethers prior to tether tensioning.

6. The tension leg platform as set forth in claim 1, further comprising a plurality of slotted tether support brackets secured to a lower exterior position on said columns, each of said tethers being received within a corresponding one of said slotted tether support brackets.

7. The tension leg platform as set forth in claim 6, wherein the upper end of each tether is threaded, said tension leg platform further comprising a threaded support nut on said threaded portion, said nut being supported on the corresponding slotted tether support bracket.

8. The tension leg platform as set forth in claim 7, further comprising a flex bearing interposed between each support bracket and the corresponding support nut.

9. A tension leg platform, comprising:

a foundation element secured at an ocean bottom location;

a buoyant hull positioned at the ocean surface above said foundation element;

a plurality of elongate, substantially vertical tethers, said tethers each having a lower end secured to said foundation element, said tethers extending upward to a position a spaced distance below the bottom of said hull;

a plurality of tether extenders, said tether extenders each having a lower end secured to the upper end of a corresponding one of said tethers, said tether extenders each being supported by said hull at a location above said tether extender lower end;

means for connecting and disconnecting each tether extender to the corresponding one of said tethers while said corresponding tether is secured to said foundation element;

at least one tether tensioning tool adapted to adjust the tension of any tether within a group of said tethers, said tether tensioning tool including:

means for releaseably securing said tether tensioning tool to a selected tether extender; and means for selectively moving the selected tether extender upward and downward relative to the hull; and means for moving said tether tensioning tool from one tether extender to another.

10. The tension leg platform as set forth in claim 9, wherein said tension leg platform has a plurality of columns, said tethers being arranged in a plurality of groups, each group being secured by said tether extenders to a corresponding one of said columns, each column housing a single tether tensioning tool.

11. The tension leg platform as set forth in claim 10, wherein each of said tether extenders extends upward from the corresponding tether to a position within said columns.

12. The tension leg platform as set forth in claim 10, wherein said each of said tether extenders extends upward from the corresponding tether to a position external and laterally adjacent to a corresponding one of said columns.

13. A tension leg platform, comprising:

a foundation element at an ocean bottom location;

a buoyant hull positioned at the ocean surface above said foundation element;

a plurality of elongate, substantially vertical tethers, each of said tethers having a lower end secured to said foundation element and an upper end positioned a spaced distance below the bottom of said hull;

a plurality of rigid tether extenders, each of said tether extenders having a lower end releaseably secured to the upper end of a corresponding one of said tethers and an upper end extending into said hull;

a plurality of flex bearings secured within said hull, each flex bearing supporting a corresponding tether extender, whereby each tether extender can pivot relative to said hull to accommodate lateral movement of said hull;

means for releaseably locking each tether extender against relative downward movement through the corresponding one of said flex bearings;

at least one tether tensioning tool within said hull for adjusting the tension of any tether within a group of said tethers, said tether tensioning tool including:

means for releaseably securing said tether tensioning tool to a selected tether extender; and means for selectively moving the selected tether extender upward and downward relative to the hull; and means for moving said tether tensioning tool from one tether extender to another, whereby a single tether tensioning tool can be used to tension a plurality of tethers.

14. The tension leg platform as set forth in claim 13, wherein said releaseably locking means includes a threaded portion at the upper end of each tether extender and a threaded load nut on said threaded portion; said tether tensioning tool including means for threading said load nut upward and downward on said tether extender threaded portion.

15. The tension leg platform as set forth in claim 13, further comprising a plurality of shrouds extending upward into said hull from the hull bottom, each shroud supporting a corresponding one of said flex bearings.

16. The tension leg platform as set forth in claim 13, wherein said tether tensioning tool includes a hydraulic cylinder unit having a cylinder and a piston, and wherein said tensioning tool securing means includes a connector adapted to secure said piston to said tether extender.

17. The tension leg platform as set forth in claim 13, wherein said moving means is at least one hoist positioned above a set of said shrouds.

18. A tension leg platform, comprising:

a buoyant hull at the ocean surface, said hull including a work deck positioned above the ocean surface and a plurality of columns extending downward from said work deck to a position below the ocean surface;

a foundation at the ocean bottom below said hull;

a plurality of vertical tethers each having a lower end secured to said foundation and an upper end proximate a lower position on a corresponding one of said columns;

a plurality of support bearings, each being secured to one of said columns;

a plurality of elongate tether extenders, each having a lower end adapted to be secured to the upper end of a corresponding tether after said tether has been secured to said ocean bottom foundation, said tether extenders each being supported by a corresponding support bearing at a preselected point along the length of said tether extender, whereby a preselected length of said tether extender projects below said support bearing;

at least one tether tensioning tool, said tool being adapted to be releaseably secured to a selected tether extender and to move said tether extender a spaced axial distance through the corresponding support bearing whereby the distance said tether extender projects below said support bearing may be altered to adjust the tension imposed on the corresponding tether; and means for moving said tensioning tool from one tether extender to another.

19. The tension leg platform as set forth in claim 18, wherein said support bearings are flex bearings.

20. The tension leg platform as set forth in claim 18, wherein there is a spaced vertical distance between the upper end of each tether and the lower end of the corresponding column.

21. The tension leg platform as set forth in claim 18, wherein said support bearings are positioned exterior to said columns.

22. The tension leg platform as set forth in claim 18, wherein each support bearing is positioned within one of said columns.

23. The tension leg platform as set forth in claim 22, wherein there is one tensioning tool within each column.

24. A tension leg platform hull adapted for use with a preinstalled tether system, said tension leg platform hull comprising:

a work deck;

a plurality of columns extending downward from said work deck to positions below the ocean surface, said columns having bottom portions, said columns defining a plurality of recesses extending upward into said columns from said column bottom portions;

a plurality of flex bearings, each secured within a corresponding one of said recesses;

a plurality of substantially vertical, elongate tether extenders, each having an upper end and a lower end, each tether extender having a tether connection element at its lower end, each tether extender being adapted to be moved vertically along its flex bearing to vary the length of the tether extender projecting below said flex bearing;

means for selectively locking each tether extender against downward movement relative to its flex bearing at any of a range of points along the length of said tether extender;

at least one tether tensioning tool, said tool being adapted to be releaseably connected to a selected tether extender and to move said tether extender a selected vertical distance relative to said flex bearing, whereby the distance said tether extender projects below said flex bearing can be adjusted to adjust the tension imposed on the corresponding one of said tethers; and means for moving said tensioning tool from one tether extender to another whereby a single tensioning tool can individually service a group of tether extenders.

25. The tension leg platform hull as set forth in claim 24, wherein each support element is a flex bearing.

26. The tension leg platform hull as set forth in claim 24, wherein said tether tensioning tool includes a hydraulic cylinder.

27. The tension leg platform hull as set forth in claim 26, wherein said hydraulic cylinder has a main body adapted to rest on said support element and a cylinder rod adapted to be secured to said tether extender.

28. The tension leg platform hull as set forth in claim 24, further comprising a plurality of shrouds extending upward into each column from the column bottom, said shrouds defining said recesses.

29. The tension leg platform hull as set forth in claim 28, wherein said support elements are flex bearings, each flex bearing being secured within a corresponding shroud.

30. A method for installing a tension leg platform at an offshore location, said method comprising the steps of:

a. establishing a foundation for said tension leg platform on the ocean floor at said offshore location;

b. securing a plurality of tethers in substantially vertical orientation to said foundation, said tethers each having a lower end secured to said foundation and an upper end situated a spaced distance below the ocean surface;

c. positioning a tension leg platform hull above said foundation, said hull having a draft which is less than the distance from the ocean surface to the upper ends of said tethers, whereby clearance exists between the upper ends of said tethers and the bottom of said hull;

d. securing a moveable tether tensioning tool to the upper end of a first rigid tether extender supported by said hull;

e. lowering said rigid tether extender from said hull to the upper end of a corresponding one of said tethers;

f. securing said rigid tether extender to the upper end of said corresponding tethers;

g. biasing said tether extender upward with said tensioning tool until the corresponding tether reaches a preselected tension level;

h. locking said tether extender against downward motion relative to said hull; and i. moving said moveable tether tensioning tool to a secured tether extender and repeating steps e–h for a corresponding second tether.

31. A tension leg platform hull adapted for use with a preinstalled tether system, said tension leg platform hull comprising:

a work deck;

a plurality of columns extending downward from said work deck to positions below the ocean surface, said columns having bottom portions;

a plurality of shrouds extending upward into each column from the column bottom portion to define a plurality of recesses in each column bottom portion;

a plurality of support elements, each secured within a corresponding one of said recesses;

a plurality of substantially vertical, elongate tether extenders, each having an upper end and a lower end, each tether extender having a tether connection element at its lower end, each tether extender being adapted to be moved vertically along its support element to vary the length of the tether extender projecting below said support element;

means for selectively locking each tether extender against downward movement relative to its support element at any of a range of points along the length of said tether extender;

at least one tether tensioning tool, said tool being adapted to be releaseably connected to a selected tether extender and to move said tether extender a selected vertical distance relative to said support element, whereby the distance said tether extender projects below said support element can be adjusted to adjust the tension imposed on the corresponding one of said tethers; and means for moving said tensioning tool from one tether extender to another whereby a single tensioning tool can individually service a group of tether extenders.

32. The tension leg platform hull as set forth in claim 31, wherein said support elements are flex bearings, each flex bearing being secured within a corresponding shroud.

33. A tension leg platform, comprising:

a foundation element secured at an ocean bottom location;

a buoyant hull positioned at the ocean surface above said foundation element;

a plurality of elongate, substantially vertical tethers, said tethers each having a lower end secured to said foundation element, said tethers extending upward to a position a spaced distance below the bottom of said hull;

a plurality of tether extenders, each of said tether extenders having a lower end secured to the upper end of a corresponding one of said tethers, said tether extenders each being supported by said hull at a location which is above said tether extender lower end and which is also external and laterally adjacent to a corresponding one of said columns;

at least one tether tensioning tool adapted to adjust the tension of any tether within a group of said tethers, said tether tensioning tool including:

means for releaseably securing said tether tensioning tool to a selected tether extender; and means for selectively moving the selected tether extender upward and downward relative to the hull; and means for moving said tether tensioning tool from one tether extender to another.

34. The tension leg platform as set forth in claim 33, wherein said tension leg platform has a plurality of columns, said tethers being arranged in a plurality of groups, each group being secured by said tether extenders to a corresponding one of said columns, each column housing a single tether tensioning tool.

35. The tension leg platform as set forth in claim 34, wherein each of said tether extenders extends upward from the corresponding tether to a position within said columns.

36. The tension leg platform as set forth in claim 34, wherein said each of said tether extenders extends upward from the corresponding tether to a position external and laterally adjacent to a corresponding one of said columns.

* * * * *